United States Patent [19]

Jaffe et al.

[11] 4,081,974

[45] Apr. 4, 1978

[54] KNITTING MACHINE CARRIAGE WITH HALL EFFECT DETECTING MEANS

[75] Inventors: Wolfgang Jaffe, Roselle Park; Joseph James Lukawich, Somerville, both of N.J.

[73] Assignee: The Singer Company, New York, N.Y.

[21] Appl. No.: 752,049

[22] Filed: Dec. 20, 1976

[51] Int. Cl.[2] ..... D04B 7/00; D04B 15/66

[52] U.S. Cl. ..... 66/75.2; 66/154 A

[58] Field of Search ..... 66/154 A, 75 A; 324/34 PS, 34 D, 41, 45, 46

[56] References Cited

U.S. PATENT DOCUMENTS

| | | | |
|---|---|---|---|
| 3,179,856 | 4/1965 | Kuhrt et al. | 324/45 |
| 3,187,127 | 6/1965 | Hess | 324/34 RS |
| 3,313,128 | 4/1967 | Schmidt et al. | 66/154 A |
| 3,313,129 | 4/1967 | Stock | 66/154 A |
| 3,340,467 | 9/1967 | Ha | 324/41 |
| 3,656,321 | 4/1972 | Flad | 66/75.2 |
| 3,760,610 | 9/1973 | Hadam et al. | 66/75.2 |
| 3,782,136 | 1/1974 | Ploppa et al. | 66/75.2 |
| 3,783,642 | 1/1974 | Hadam | 66/75.2 |
| 3,955,383 | 5/1976 | Hasegawa et al. | 66/154 A |
| 3,955,384 | 5/1976 | Hasegawa et al. | 66/154 A |

*Primary Examiner*—Ronald Feldbaum

*Attorney, Agent, or Firm*—William V. Ebs; Edward L. Bell; Robert E. Smith

[57] ABSTRACT

The carriage of a flat bed knitting machine is provided with Hall effect devices at locations in close proximity to a steel needle bed and as the carriage is moved along the bed, one or another of the devices produces an output signal each time it passes over a steel segment separating slots in the bed.

2 Claims, 5 Drawing Figures

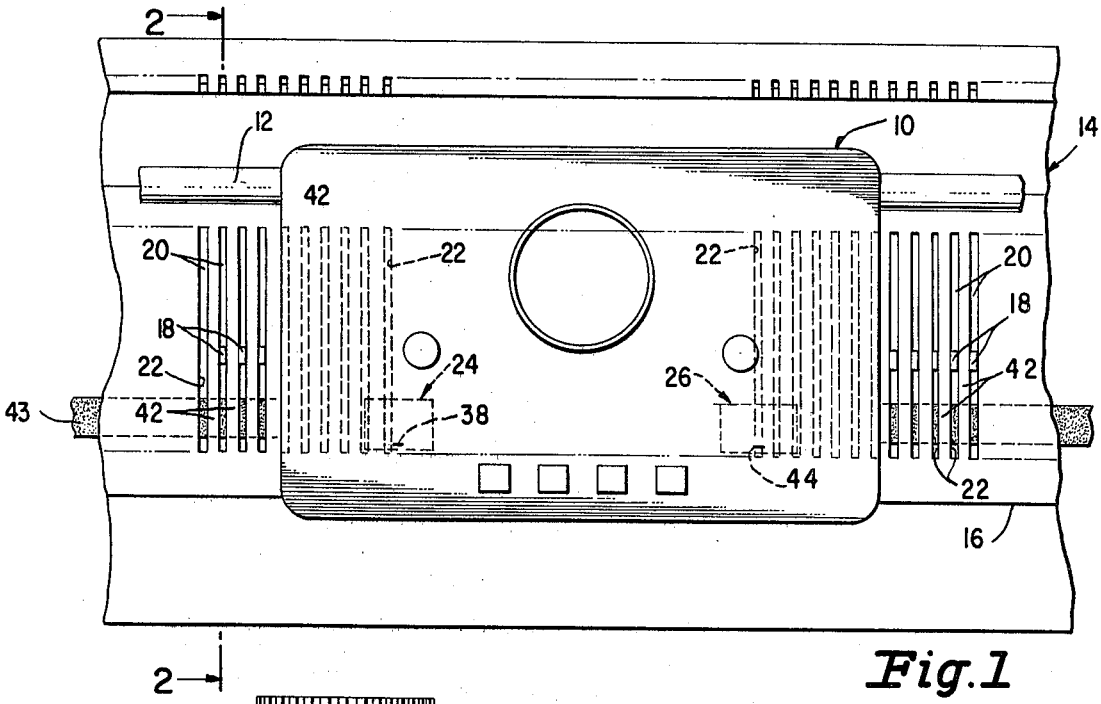
Fig. 1
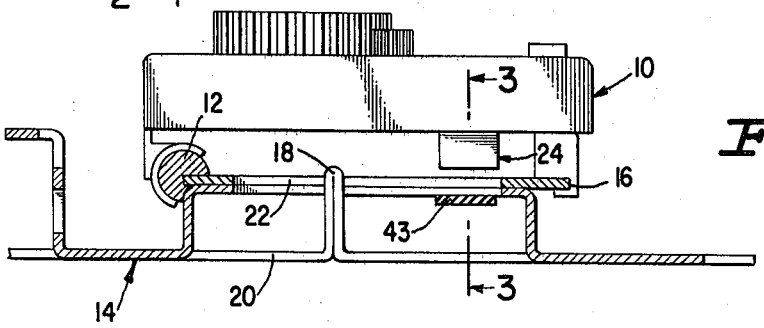
Fig. 2
Fig. 4
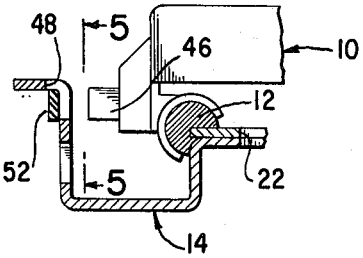
Fig. 3
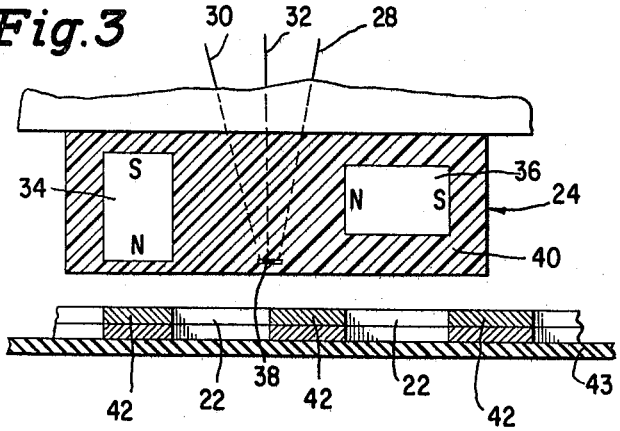
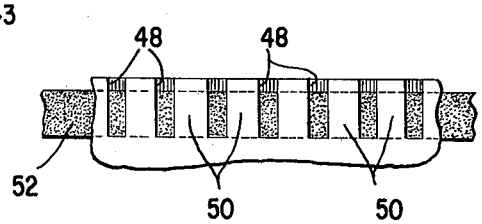
Fig. 5

KNITTING MACHINE CARRIAGE WITH HALL EFFECT DETECTING MEANS

BACKGROUND OF THE INVENTION

1. Field of the Invention

The invention relates to flat bed knitting machines and more particularly is directed to means for detecting movement of the carriage of such a machine across its needle bed.

2. Description of the Prior Art

In automated flat bed knitting machines including needle selecting means in a carriage and electronic control means for causing the needle selectors to operate on particular needles pursuant to a predetermined program as the carriage is moved back and forth across the needle bed, it is necessary to generate signals from which the position of the carriage can be determined and to provide the electronic control means with such information so that the needle selectors may be caused to operate at the proper time. Various types of pulse generators having application to the control of automatic knitting machines have been known for some time, such devices being disclosed for example in U.S. Pat. No. 3,313,129, 3,339,381, and 3,782,136. The prior art devices however, have proved to be unreliable in operation or unduly costly when applied to a knitting machine, and it is a prime object of this invention to provide a signal generator which has neither of these disadvantages.

SUMMARY OF THE INVENTION

In accordance with the invention the carriage of a flat bed knitting machine is provided in close proximity to a steel needle bed with Hall effect detecting means of the kind disclosed in the U.S. Patent Application of Wolfgang Jaffe Ser. No. 748,434 for Dual Magnet Hall Effect Device filed Dec. 8, 1976 and assigned to the same Assignee as the present invention, such Hall effect detecting means including a pair of magnets with their axes in quadrature and a Hall effect sensor located between the magnets. As the carriage is moved along the needle bed, the sensor produces output signals coincident with its passage over steel segments separating slots in the bed. Preferable two Hall effect devices, each including a Hall effect sensor between the magnets in quadrature, are provided on the carriage and are so located that their sensors provide out-of-phase signals from which the direction of the carriage motion can be determined. It is also preferable to provide a strip magnet behind the needle bed and in line with the Hall effect detecting means to counteract fringing effects and thereby better define the sensor output signals.

DESCRIPTION OF THE DRAWINGS

FIG. 1 is a top plan view of a home type flat bed knitting machine equipped with Hall effect detecting means according to the invention;

FIG. 2 is a sectional view taken on the plane of the line 2—2 of FIG. 1;

FIG. 3 is an enlarged partial sectional view taken on the plane of the line 3—3 of FIG. 2; and FIG. 4 is a partial sectional view showing a modified form on the invention.

FIG. 5 is a view taken on the plane of the line 5—5 of FIG. 4.

DESCRIPTION OF THE PREFERRED EMBODIMENT

Referring to FIGS. 1, 2 and 3 of the drawings, reference character 10 designates the carriage of a home type flat bed knitting machine. The rear of the carriage is slidably supported on a tubular member 12 which is affixed to the steel bed 14 of the machine, and the front of the carriage is slidably supported on the lip 16 of the bed. Camming and programmable electromagnetic needle selecting means which are not shown in the drawings, but which may be of the type shown and described in U.S. Patent Application Ser. No. 627,431 for "Automatic Knitting Machine" filed Oct. 30, 1975 and assigned to the same Assignee as the present invention are provided on the underside of the carriage for the purpose of acting on the butts 18 of knitting needles 20 to thereby slidably move the needles in the bed as required to knit a patterned fabric. The needles move transversely in the bed, the butts 18 being guided in parallel transverse slots 22 of the bed 14.

In accordance with the invention, the carriage is provided with one or more Hall effect devices of the kind disclosed in the aforementioned patent application of Wolfgang Jaffe Ser. No. 748,434 for Dual Magnet Hall Effect Device filed Dec. 8, 1976 in close proximity to the needle bed, such that as the sensor in such device passes between slots during movement of the carriage the device is caused to generate a meaningful output signal.

Reference characters 24 and 26 designate such Hall effect devices disposed in close proximity to the needle butt slots 22. As shown in FIG. 3, the Hall effect devices include input, output and ground lines 28, 30 and 32 respectively, two magnets 34 and 36 with their axes in quadrature and a Hall effect sensor 38 between the magnets, the magnets and sensor being encased as in plastic 40 or ceramic. The sensor may be a digital output Hall effect sensor or linear output Hall effect sensor. In either event a maximum output voltage is obtained between the output and ground lines 30 and 32 each time the sensor passes over a steel segment 42 of the bed between slots 22 as the carriage is moved on the bed. Preferably a magnet, as for example, a rubber strip magnet 43 with polar axes transverse to it longitudinal dimension is provided in back of the slots to counteract the fringing of magnetic flux lines and so prevent as output signals from being generated at the position of the Hall effect device other than where the sensor is over a segment.

The two Hall effect devices 24 and 26 are located at opposite end portions of the carriage such that in extreme positions of the carriage one device may remain over the bed although the other is off the bed, and the devices are so positioned that when the sensor 38 of one device is directly over a segment 42, the sensor 44 of the other is offset with respect to a segment such as to provide for a phase relationship between the output signals from the two devices depending upon the direction of movement of the carriage. Preferable the positions are such as to provide for a phase difference of 90° which reverses when the direction of carriage movement reverses.

The signals from the Hall effect devices 24 and 26 indicating movement thereof over the segments 42 of the machine bed and indicating the direction in which the carriage is moved are used to keep track of the position of the carriage on the bed 14 and to control the firing of needle selectors in the carriage, as for example in the manner of the aforementioned U.S. Patent Application Ser. No. 627,431.

The Hall effect devices, instead of being secured to the underside of the carriage 10 to detect segments in the bed 14 between needle butt receiving slots as described, may of course be secured elsewhere on the carriage to traverse other slots in the bed, and by way of example a Hall effect device 46 is shown in FIG. 4 at the rear of the carriage to traverse slots 48 provided at the rear of the bed to detect segments 50 between these slots and to provide a strip magnet 52 behind such slots. Another possibility is to provide slots in the front flat part of the carriage and to secure the Hall effect devices to the front of the carriage at a location such that it will traverse these front slots as the carriage is moved across the bed. Such front or rear slots may be made wider than the needle butt slots to thereby narrow the width of the steel segments to be detected between the slots and so sharpen the response of the Hall effect devices.

The invention has been described with a certain degree of particularity, however, it is to be understood that the disclosure of the preferred form has been by way of example only and that numerous changes in the details of construction and in the combination and arrangement of parts may be resorted to without departing from the spirit and scope of the invention.

Having thus set forth the nature of this invention, what we hereinafter claim is:

1. In a flat bed knitting machine including a slotted needle bed and carriage slidable on the bed, a pair of dual magnet Hall-effect devices on the carriage disposed to move across slots in the bed as the carriage is moved and subject to actuation by steel in the bed as the devices move between the slots, and circuit means responsive to the operation of the Hall-effect devices, the Hall-effect devices being so located with respect to the slots in the bed as to generate out-or-phase signals from which the direction of carriage motion can be determined.

2. The combination of claim 1 including a strip magnet extending across the slots where traversed by the Hall-effect devices, said strip magnet being affixed to the needle bed on the opposite side of the slots from the Hall-effect devices.

* * * * *